US009181498B2

(12) United States Patent
Tertel et al.

(10) Patent No.: US 9,181,498 B2
(45) Date of Patent: Nov. 10, 2015

(54) APPARATUS AND PROCESS FOR REMOVAL OF SULFUR-CONTAINING COMPOUNDS FROM A HYDROCARBON STREAM

(71) Applicant: UOP LLC, Des Plaines, IL (US)

(72) Inventors: Jonathan Andrew Tertel, Mt. Prospect, IL (US); Peter A. Meister, Elk Grove Village, IL (US)

(73) Assignee: UOP LLC, Des Plaines, IL (US)

( * ) Notice: Subject to any disclaimer, the term of this patent is extended or adjusted under 35 U.S.C. 154(b) by 216 days.

(21) Appl. No.: 13/904,311

(22) Filed: May 29, 2013

(65) Prior Publication Data

US 2014/0357927 A1 Dec. 4, 2014

(51) Int. Cl.
*C10G 19/02* (2006.01)
*C10G 27/00* (2006.01)

(52) U.S. Cl.
CPC ..... *C10G 27/00* (2013.01)

(58) Field of Classification Search
None
See application file for complete search history.

(56) References Cited

U.S. PATENT DOCUMENTS

| | | | | |
|---|---|---|---|---|
| 2,945,808 | A | 7/1960 | Petty | |
| 4,090,954 | A * | 5/1978 | Ward | 208/206 |
| 4,562,300 | A | 12/1985 | LaFoy | |
| 5,244,643 | A | 9/1993 | Verachtert | |
| 6,749,741 | B1 | 6/2004 | Laricchia et al. | |
| 7,223,332 | B1 | 5/2007 | Tertel | |
| 7,326,333 | B2 | 2/2008 | Laricchia et al. | |
| 7,772,449 | B2 | 8/2010 | Kurukchi et al. | |
| 8,173,856 | B2 | 5/2012 | Tertel | |
| 2012/0000827 | A1 | 1/2012 | Krupa et al. | |
| 2013/0026086 | A1 | 1/2013 | Zhang et al. | |
| 2015/0114883 | A1 * | 4/2015 | Tertel et al. | 208/203 |

FOREIGN PATENT DOCUMENTS

GB 1337494 11/1973

OTHER PUBLICATIONS

Françoise et al. "New Kerosene Mercaptan Oxidation Process." Hydrocarbon Technology International. 1993. pp. 63-66.
Holbrook et al. "Merox Processes for Caustic Minimization and Management." Presented at the National Petroleum Refiners Association Annual Meeting, 1993. pp. 1-28.

* cited by examiner

*Primary Examiner* — Tam M Nguyen

(57) ABSTRACT

A process for removing sulfur compounds from a liquid hydrocarbon stream includes the steps of feeding the hydrocarbon stream to a recirculation section of an extraction vessel wherein the recirculation section contains a first alkaline solution; passing the hydrocarbon stream through the recirculation section; recirculating at least a part of a first alkaline stream to a top deck of one or more liquid-liquid contacting decks of the recirculation section; passing the hydrocarbon stream from the recirculation section to an extraction section of the extraction vessel wherein the extraction section includes one or more liquid-liquid contacting decks; feeding a second alkaline stream to an upper deck of the one or more liquid-liquid contacting decks of the extraction section wherein the second alkaline stream includes a second alkaline solution; and withdrawing a hydrocarbon product stream from the extraction vessel. An apparatus for removing sulfur compounds from the hydrocarbon stream is also disclosed.

9 Claims, 2 Drawing Sheets

APPARATUS AND PROCESS FOR REMOVAL OF SULFUR-CONTAINING COMPOUNDS FROM A HYDROCARBON STREAM

CROSS-REFERENCES TO RELATED APPLICATIONS

Not Applicable.

STATEMENT REGARDING FEDERALLY SPONSORED RESEARCH

Not Applicable.

BACKGROUND OF THE INVENTION

1. Field of the Invention

This invention relates generally to a process and apparatus for the removal of organic sulfur compounds from a stream containing hydrocarbons. In particular, it relates to the use of an aqueous caustic solution to remove mercaptans from a hydrocarbon stream.

2. Description of the Related Art

It is conventional practice at the present time to treat sour gas and liquid hydrocarbon streams to remove mercaptans. Extraction processes are typically used when treating light liquid hydrocarbons and gas streams for mercaptan removal. Mercaptans have traditionally been removed from hydrocarbon streams because of their malodorous scent.

U.S. Pat. No. 5,244,643 discloses a process whereby a hydrocarbonaceous gas stream including mercaptan sulfur, air and aqueous alkaline solution including a mercaptan oxidation catalyst are mixed in a mixing vessel in which mercaptans are converted to disulfides. The effluent withdrawn from the top of the mixing vessel is settled in a vessel to yield separated streams of air, liquid hydrocarbon product containing disulfide, and an aqueous alkaline solution including mercaptan oxidation catalyst.

U.S. Pat. No. 4,562,300 discloses contacting a hydrocarbon stream including organic mercaptans with sodium hydroxide to free the hydrocarbons from the organic mercaptans. The caustic solution rich in mercaptans is oxidized with a catalyst and the organic mercaptans are converted to organic disulfides. The mixture of regenerated caustic solution free of organic mercaptans and organic disulfides enter a settler in which the organic disulfides and caustic solution are separated. A stream of hydrocarbon from which the mercaptans had been extracted upstream are admixed with regenerated aqueous caustic solution containing small amounts of organic disulfides to extract the organic disulfides from the regenerated caustic solution.

In a typical liquid-liquid extraction process, a liquid hydrocarbon stream is fed to an amine absorber column to be contacted with an amine, such as diethylamine, to absorb acid gases such as hydrogen sulfide and carbon dioxide from the hydrocarbon stream. The hydrocarbon stream lean of hydrogen sulfide and other acid gases is prewashed in a prewash vessel containing 6.5 to 15.0 wt. % liquid caustic to convert the remaining hydrogen sulfide to sodium sulfide which is soluble in caustic. The hydrocarbon stream, now depleted of hydrogen sulfide, is subjected to counter-current flow of a liquid caustic in an extraction vessel. Jet decks in the extraction vessel facilitate the counter-current contact. Mercaptans in the hydrocarbon stream react with the caustic to yield mercaptides. The mercaptides in the hydrocarbon stream are soluble in the caustic. A product hydrocarbon stream lean in mercaptans passes overhead from the extraction column through a settler drum to a sand filter vessel, and the mercaptide rich caustic passes from the bottom of the column. The settler drum allows for settling and buffers the sand filter against caustic surges. The sand filter coalesces caustic to make it gravitate to the bottom of the vessel while the product hydrocarbon stream passes out of the vessel through an outlet that is shielded at the top to prevent admittance of falling caustic droplets. The mercaptide rich caustic receives an injection of air and catalyst as it passes from the extraction column to an oxidation vessel for regeneration. Oxidizing the mercaptides to disulfides using a phthalocyanine catalyst regenerates the caustic solution. A disulfide separator receives the disulfide rich caustic from the oxidation vessel. The disulfide separator vents excess air and decants disulfides from the caustic before the regenerated caustic is drained and returned to the extraction vessel. The disulfides are run through a sand filter and removed from the process.

One conventional mercaptan extraction system utilizes four vessels: the caustic prewash vessel, the extraction vessel, the settler drum, and the sand filter vessel. Each vessel must have its own support and base structure making building this system capital-intensive. U.S. Pat. No. 6,749,741 discloses combining the extraction vessel, the settler drum, and the sand filter vessel into one vessel to thereby reduce the capital required to build an extraction system. In the combined vessel, a caustic solution enters the extractor section of the vessel and passes through this portion of the vessel in order to remove mercaptans from a hydrocarbon stream resulting in spent caustic rich in mercaptides. The spent caustic is then recovered from the extractor section of the vessel and regenerated in a downstream process. The regenerated caustic can then be recycled back to the extractor section of the vessel. Furthermore, spent caustic in the prewash section of the vessel that is rich in sulfide salts can be recovered. Part of the recovered caustic is recycled back to the prewash section of the vessel while the remainder is removed from the process.

In the above described mercaptan extraction system, the caustic is regenerated to allow reuse in the extraction vessel, thus limiting the amount of caustic needed. However, the need for a caustic regeneration necessitates additional capital to build a regeneration system.

Accordingly, what is needed is a "once-through" type extraction vessel, where the caustic is only used once before being sent to effluent treatment to thereby further reduce the capital required to build an extraction system. Also, there is a need for a "once-through" type extraction vessel which minimizes the amount of fresh and spent caustic that is needed.

SUMMARY OF THE INVENTION

In one aspect, the invention provides a process for removing sulfur compounds from a liquid hydrocarbon stream. The process includes the steps of: (a) feeding a liquid hydrocarbon stream to a recirculation section of an extraction vessel wherein the recirculation section includes a feed deck and one or more liquid-liquid contacting decks above the feed deck, wherein the recirculation section contains a first alkaline solution suitable for converting mercaptans to mercaptides; (b) passing the hydrocarbon stream through the recirculation section; (c) withdrawing a first alkaline stream including the first alkaline solution and mercaptides from the recirculation section; (d) recirculating at least a part of the first alkaline stream to a top deck of the one or more liquid-liquid contacting decks of the recirculation section; (e) passing the hydrocarbon stream from the recirculation section to an extraction section of the extraction vessel wherein the extraction section includes one or more liquid-liquid contacting decks; (f) feeding a second alkaline stream to an upper deck of the one or more liquid-liquid contacting decks of the extraction section wherein the second alkaline stream includes a second alkaline solution suitable for converting mercaptans to mercaptides; and (g) withdrawing a hydrocarbon product stream from an exit opening of the extraction vessel. The second alkaline stream can include an alkaline solution essentially free of mercaptides. Step (a) can comprise feeding the liquid hydrocarbon stream to the recirculation section at a location above the feed deck. Step (f) can comprise feeding the second alkaline stream behind a weir that extends upward from the upper deck of the one or more liquid-liquid contacting decks of the extraction section. In one version of the method, each of the liquid-liquid contacting decks of the recirculation section includes a perforated section, and each of the liquid-liquid contacting decks of the extraction section includes a perforated section.

In another aspect, the invention provides a process for removing sulfur compounds from a liquid hydrocarbon stream. The process includes the steps of: (a) feeding a liquid hydrocarbon stream to a recirculation section of an extraction vessel wherein the recirculation section includes a feed deck and one or more liquid-liquid contacting decks above the feed deck, wherein the recirculation section contains a first alkaline solution suitable for converting mercaptans to mercaptides; (b) passing the hydrocarbon stream through the recirculation section; (c) withdrawing a first alkaline stream including the first alkaline solution and mercaptides from the recirculation section; (d) recirculating at least a part of the first alkaline stream to a top deck of the one or more liquid-liquid contacting decks of the recirculation section; (e) passing the hydrocarbon stream from the recirculation section to an extraction section of the extraction vessel wherein the extraction section includes one or more liquid-liquid contacting decks; (f) feeding a second alkaline stream to an upper deck of the one or more liquid-liquid contacting decks of the extraction section wherein the second alkaline stream includes a second alkaline solution suitable for converting mercaptans to mercaptides; and (g) withdrawing a hydrocarbon product stream from an exit opening of the extraction vessel, wherein the first alkaline stream and the second alkaline stream are caustic, and wherein the process does not include a caustic regeneration system. In one form, the feed deck has an imperforate bottom wall. The extraction section can be in direct communication with the exit opening of the extraction vessel. A majority of the mercaptans in the liquid hydrocarbon stream fed to the recirculation section are converted to mercaptides in the recirculation section.

In yet another aspect, the invention provides an apparatus for removing sulfur compounds from a liquid hydrocarbon stream. The apparatus includes (i) a liquid hydrocarbon source; (ii) an extraction vessel in fluid communication with the liquid hydrocarbon source, wherein the extraction vessel includes a recirculation section in fluid communication with an extraction section downstream of the recirculation section, wherein the extraction section includes one or more liquid-liquid contacting decks, wherein the recirculation section includes a feed deck and one or more liquid-liquid contacting decks above the feed deck, wherein the recirculation section contains a first alkaline solution suitable for converting mercaptans to mercaptides; (iii) a recirculation conduit having a first alkali inlet below the feed deck of the recirculation section and having a first alkali outlet above a top deck of the one or more liquid-liquid contacting decks of the recirculation section; and (iv) an alkaline inlet conduit in fluid communication with a source of a second alkaline solution suitable for converting mercaptans to mercaptides, wherein the alkaline inlet conduit has a second alkali outlet above a top deck of the one or more liquid-liquid contacting decks of the extraction vessel. The recirculation section can includes two to six liquid-liquid contacting decks above the feed deck. The extraction section can include two to four liquid-liquid contacting decks. The first alkali inlet can be in fluid communication with a bottom of the recirculation section. The first alkaline solution and the second alkaline solution can have different concentrations. Each of the liquid-liquid contacting decks of the recirculation section can include a perforated section, and each of the liquid-liquid contacting decks of the extraction section can include a perforated section. In one form, the feed deck has an imperforate bottom wall. The extraction section can be in direct communication with an exit opening of the extraction vessel. The first alkaline solution and the second alkaline solution can be caustic. In one form, the apparatus does not include a caustic regeneration system. The extraction vessel can be in fluid communication with the liquid hydrocarbon source via a liquid hydrocarbon conduit having an outlet located above the feed deck. The recirculation section can be in fluid communication with the extraction section internally within walls of the extraction vessel.

It is therefore an advantage of the invention to provide a process and an apparatus for removing sulfur compounds from a liquid hydrocarbon stream. The process and apparatus use an extraction vessel with jet decks where caustic and hydrocarbon (e.g., liquefied petroleum gas or naphtha) contact counter-currently. The liquid hydrocarbon is introduced through a distributor above a blind feed deck and goes upwards through holes in the trays. Fresh caustic is introduced behind a weir on the top deck, and flows downward through downcomers. The caustic is recirculated from the bottom of the extraction vessel to a jet deck in the middle. This provides the bulk removal of the mercaptan on these decks. The final removal to very low levels can be done on the top two to four trays by fresh caustic. The process and apparatus reduce the amount of fresh caustic needed, while still getting the mercaptan in the liquid hydrocarbon to very low levels. Thus, the invention utilizes the ability for a "once-through" type system, while still minimizing the amount of fresh caustic (and spent caustic) that is needed. This reduces the operating cost.

In prior extraction units, the caustic is regenerated to allow reuse in the extractor, thus limiting the amount of effluent. There can be significant capital costs for the regeneration system. Thus, the present invention provides a "once-through' type extractor, where the caustic is only used once before being sent to effluent treatment.

These and other features, aspects, and advantages of the present invention will become better understood upon consideration of the following detailed description, drawings and appended claims.

BRIEF DESCRIPTION OF THE DRAWINGS

Like reference numerals will be used to refer to like parts from Figure to Figure in the following description of the drawings.

DETAILED DESCRIPTION OF THE INVENTION

Figure 1:
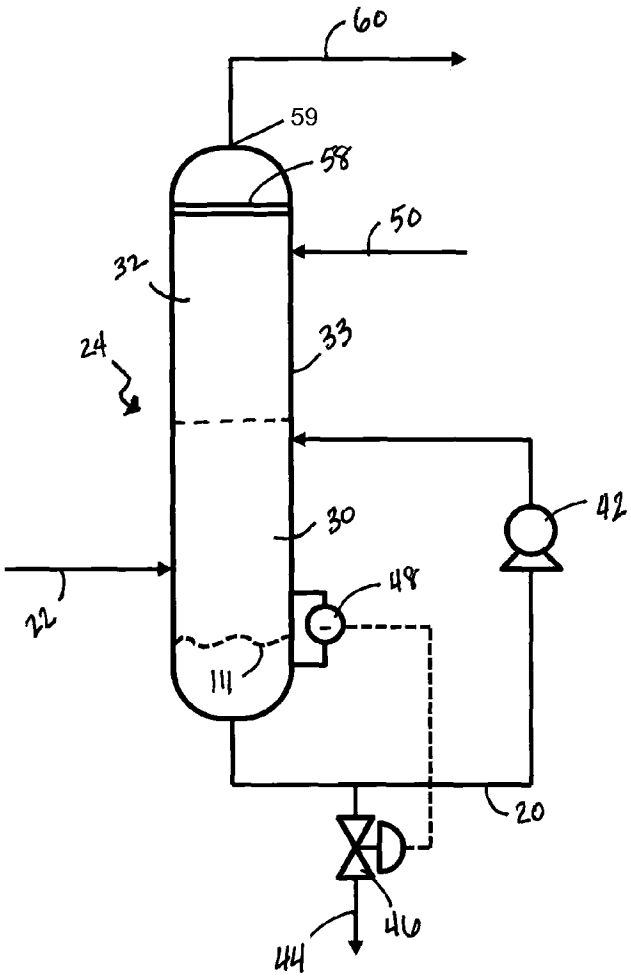
FIG. 1 is a process flow scheme for one embodiment of a process of the present invention.

A general understanding of the process and apparatus of this invention can be obtained by reference to the Figures. The Figures have been simplified by the deletion of certain vessel internals, temperature and pressure controls systems, flow control valves, recycle pumps, etc. which are not specifically required to illustrate the performance of the process and apparatus. Furthermore, the illustration of the process of this invention in the embodiment of a specific drawing is not intended to limit the invention or to include other embodiments set out here, or reasonably expected modifications thereof. Lastly, although aqueous caustic is mentioned as the preferred reagent for converting sulfur compounds, other aqueous alkaline solutions are contemplated.

A hydrocarbon effluent, which includes mercaptans and which may be essentially free of $H_2S$ and $CO_2$, enters an extraction vessel 24 through the line 22. The hydrocarbon effluent can be from an amine absorber vessel. The extraction vessel 24 comprises a lower caustic recirculation section 30 and an upper once-through extraction section 32. The once-through extraction section 32 is directly above the recirculation section 30 and both sections preferably share at least one common wall 33. The line 22 feeds the recirculation section 30 proximate a bottom of the recirculation section 30 above a feed tray 102.

In the recirculation section 30, an aqueous alkaline solution such as caustic of about 17 to 25 Baume (12 to 19 wt. %), preferably 18 to 22 Baume (13 to 16 wt. %) and typically 19-21 Baume reacts with mercaptans in the liquid hydrocarbon to yield sodium mercaptides and water. The alkaline solution can comprise any alkali metal hydroxide or alkaline earth metal hydroxide. Preferably, the alkaline solution comprises an alkaline hydroxide and most preferably, the alkaline solution comprises a caustic such as sodium hydroxide.

The higher density aqueous caustic, and mercaptides dissolved therein gravitate to the bottom of the recirculation section 30 while the liquid hydrocarbon depleted of the bulk of the mercaptans rises to the top of the recirculation section 30. A pump 42 circulates caustic out of the bottom of the recirculation section 30 through the recirculation conduit 20. Spent caustic is withdrawn from the recirculation conduit 20 through a line 44 regulated by a control valve 46. The flow rate of caustic through the control valve 46 is automatically controlled by a level indicator controller 48 which monitors the level of caustic in the recirculation section 30 at the hydrocarbon-caustic interface 111. The level indicator controller 48 sensing the level of caustic in the recirculation section 30 signals a setting for the control valve 46 relative to partially open to bring the level of the caustic in the recirculation section 30 to a desired, preset level. Accordingly, spent caustic is continuously withdrawn from the recirculation section 30 through the line 44 via the recirculation conduit 20. The spent caustic withdrawn through the line 44 may be sent to a spent caustic degassing drum (not shown) which allows volatile hydrocarbons to evaporate off of the top of the drum before the spent caustic descends out of the drum to treatment. Fresh or regenerated caustic in a line 50 is continuously fed to the once-through section 32 and hence to the recirculation section 30. The caustic fed in line 50 is preferably essentially free of mercaptides. The flow of caustic in line 50 is essentially the same as the flow of caustic in line 44.

An aqueous alkaline solution such as aqueous caustic in the once-through extraction section 32 has a concentration of 17 to 25 Baume (12 to 19 wt. %), preferably 18 to 22 Baume (13 to 16 wt. %) and typically 19-21 Baume. Mercaptans in both the once-through extraction section 32 and recirculation section 30 react with the caustic to yield sodium mercaptides and water. The lower density hydrocarbons rise to the top of the once-through extraction section 32 while the aqueous caustic and mercaptides dissolved in the aqueous caustic sink to the bottom of the once-through extraction section 32 and hence to the recirculation section 30. The liquid hydrocarbon rises to a coalescer 58 comprising a mesh blanket which coalesces smaller caustic droplets carried to the top of the once-through extraction section 32 with hydrocarbon because of their smaller size. The coalescer 58 coalesces smaller droplets of caustic together to form larger droplets that will tend to sink back to the bottom of the once-through extraction section 32. Treated hydrocarbon substantially devoid of mercaptans and mercaptides exits the once-through extraction section 32 at an exit opening 59 via a product conduit 60.

As noted above, spent caustic rich in mercaptides is withdrawn through the bottom of the recirculation section 30 through a line 20. This invention does not require that the spent caustic rich in mercaptides be regenerated. However, certain embodiments of the invention may involve regeneration of the caustic. The regenerated caustic can then be recycled to the once-through extraction section 32 of the extraction vessel 24 by the line 50.

Figure 2:
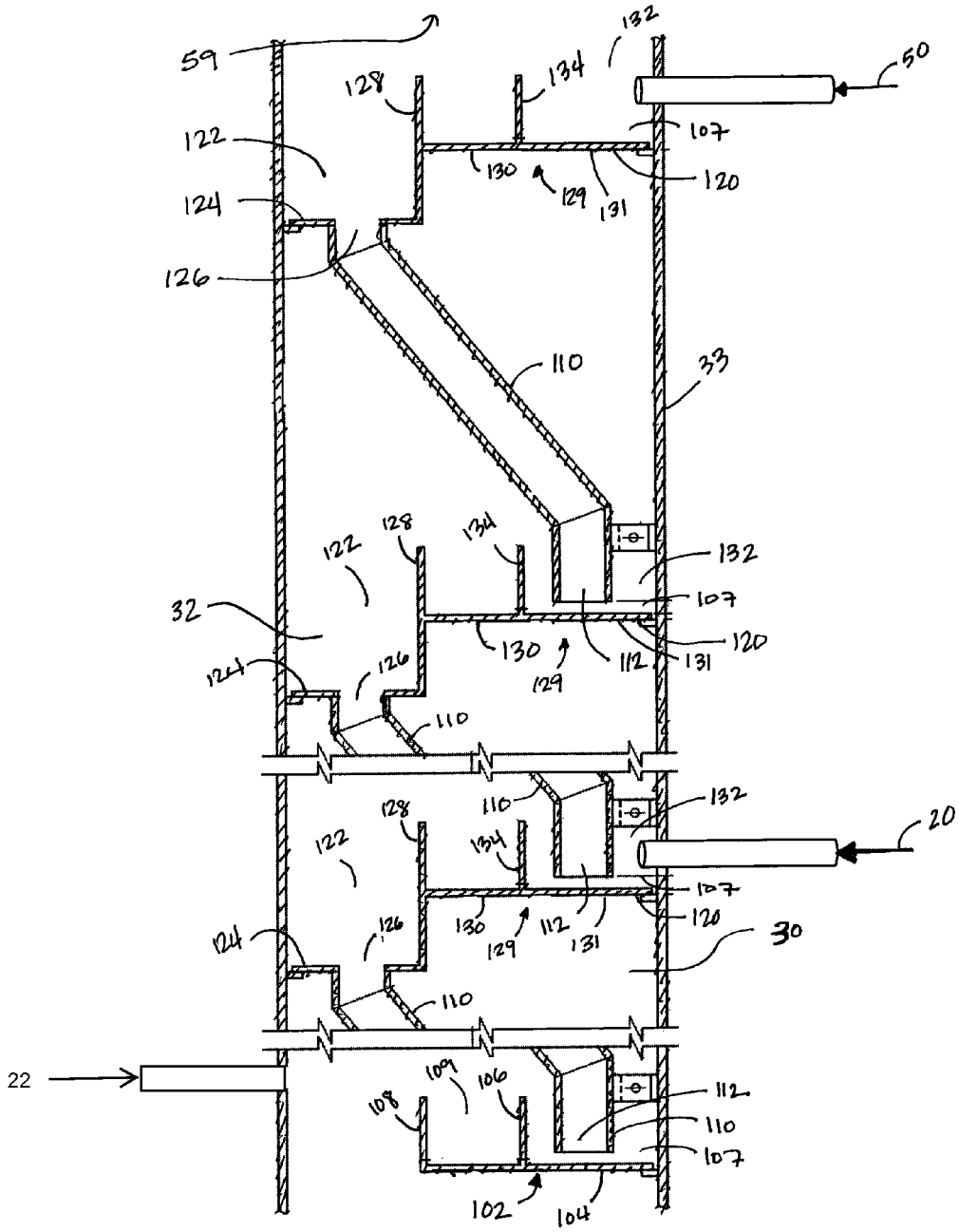
FIG. 2 is a cross-section of the extraction vessel of FIG. 1.

FIG. 2 shows a portion of the internals of the extraction vessel 24 in greater detail. Both the recirculation section 30 and once-through extraction section 32 contain a plurality of liquid-liquid contacting decks 102,120. A feed deck 102 residing near the bottom of the recirculation section 30 of the extraction vessel 24 comprises a horizontal plate 104 extending partially across the cross-sectional area of the once-through extraction section 32 and two upstanding weirs 106 and 108. A feed pan 109 is defined by the weirs 106, 108, the plate 104, and an inner surface of the common wall 33 of the once-through section extraction 32 of the extraction vessel 24. A downcomer 110 has an outlet 112 disposed in an inlet pan 107 defined by the plate 104, the weir 106, and the inner surface of the common wall 33 of the extraction vessel 24. The liquid hydrocarbon effluent from the amine absorber vessel 12 enters the extraction vessel 24 through the line 22 which is in fluid communication with the feed pan 109 of the feed deck 102.

FIG. 2 shows a plurality of liquid-liquid contacting decks 120 (also known as jet decks) above the feed deck 102 in the recirculation section 30 of the present invention. Suitably, two to six jet decks are used in the recirculation section 30, with two to four jet decks being used in one non-limiting example embodiment, and two jet decks being used in another non-limiting example embodiment. A plurality of jet decks 120 also reside in the once-through extraction section 32 of the present invention. Suitably, two to four decks are used in an once-through extraction section 32, with two jet decks being used in the extraction section 32 in a non-limiting example embodiment. Additionally, other types of structures for facilitating liquid-liquid contact, such as packed beds or trays are contemplated. Each jet deck 120 includes an outlet pan 122 defined by an inner surface of the common wall 33 of the extraction vessel 24, a horizontal pan plate 124, which communicates with an inlet 126 of the downcomer 110, and a vertical weir 128. The jet decks 120 also include a plate 129 comprising a perforate sieve section 130 and an imperforate section 131. The imperforate section 131 is separated from the sieve section 130 by a vertical weir 134. An inlet pan 132 is defined by the imperforate section 131, the inner surface of the common wall 33 and the weir 134. Fresh or regenerated caustic from the line 50 is fed to the inlet pan of the topmost jet deck 120.

In this non-limiting example embodiment, the vertical weirs 106, 108 extend chordally across the recirculation section 30 to define the inlet pan 107 and the feed pan 109. Furthermore, the vertical weirs 128, 134 extend chordally across the once-through extraction section 32 and recirculation section 30 to define the inlet pan 132 and the outlet pan 122. The height of the weirs 106, 108, 128, and 134 are about 30 centimeters (about 1 foot) so when caustic exceeds 30 centimeters (about 1 foot) in depth, it spills over the respective weir. The height of the weirs may be made taller. In the feed deck 102, caustic spilling out of the inlet pan 107 and feed pan 109 spills down to a caustic-hydrocarbon interphase 111 below the feed deck 102. In the case of the jet decks 120, spilling caustic flows onto the sieve section 130 to contact hydrocarbon ascending through perforations in the sieve section 130. Caustic that makes it way into the outlet pan 122 of the jet decks 120 proceeds through the inlet 126 of the downcomer 110 down into the inlet pans 132, 107 of the subjacent jet deck 120 or feed deck 102, respectively, through the outlet 112. This arrangement assures adequate contact between the liquid hydrocarbon and the caustic while the hydrocarbon rises to the top of the once-through extraction section 32 and out through the product conduit 60.

In a non-limiting example embodiment of the present invention, the recirculation section 30 of the extraction vessel 24 contains one feed deck and three jet decks 120 and the once-through extraction section 32 contains two jet decks 120. The caustic recirculation line 20 is in fluid communication with the inlet pan 132 of the top-most jet deck 120 of the recirculation section 30. The fresh or regenerated caustic is in fluid communication with the inlet pan 132 of the upper-most jet deck 120 of the once-through extraction section 32 of the extraction vessel 24 by the line 50. One advantageous aspect of the invention is that the recirculation of caustic will provide the bulk removal of the mercaptan from the hydrocarbon on the feed deck 102 and jet decks 120 in the recirculation section 30. The final reduction of mercaptan concentration in the hydrocarbon occurs on the jet decks in the once-through extraction section 32 of the extraction vessel 24. The advantage of this system is that it reduces the amount of fresh caustic needed, while still reducing the concentration of mercaptan in the hydrocarbon product to be in the range of about 0 ppm to about 10 ppm.

Proximate a top of the once-through extraction section 32 above the jet decks 120 is the coalescer 58. The coalescer 58 can comprise a mesh blanket that extends across the entire cross-sectional area of the once-through extraction section 32. Preferably, the coalescer 58 is of sufficient quality so as to permit no more than 2 ppm caustic and preferably no more than 1 ppm caustic to pass through it because it is the last barrier preventing caustic from leaving with the hydrocarbon product. The coalescer 58 is spaced apart from the top jet deck 120 to provide an open settling volume therebetween to act as a buffer in the event of a caustic surge. The settling volume occupies at least as much volume to accommodate one more jet deck 120. The coalescer 58 and the settling volume in the extraction vessel 24 obviate the need for the sand filter and the settling drum vessels in prior conventional liquid-liquid extraction processes. Downstream of the coalescer 58, the extraction section 32 is in direct communication with the exit opening 59. The term "direct communication" means that flow from the extraction section 32 downstream of the coalescer 58 enters the exit opening 59 without undergoing a compositional change due to physical fractionation or chemical conversion.

Thus, the invention provides a process and an apparatus for the removal of organic sulfur compounds from a liquid hydrocarbon stream.

Although the invention has been described in considerable detail with reference to certain embodiments, one skilled in the art will appreciate that the present invention can be practiced by other than the described embodiments, which have been presented for purposes of illustration and not of limitation. Therefore, the scope of the appended claims should not be limited to the description of the embodiments contained herein.

What is claimed is:

1. A process for removing sulfur compounds from a liquid hydrocarbon stream, the process comprising:

(a) feeding a liquid hydrocarbon stream to a recirculation section of an extraction vessel, the recirculation section including a feed deck and one or more liquid-liquid contacting decks above the feed deck, the recirculation section containing a first alkaline solution suitable for converting mercaptans to mercaptides;

(b) passing the hydrocarbon stream through the recirculation section;

(c) withdrawing a first alkaline stream including the first alkaline solution and mercaptides from the recirculation section;

(d) recirculating at least a part of the first alkaline stream to a top deck of the one or more liquid-liquid contacting decks of the recirculation section;

(e) passing the hydrocarbon stream from the recirculation section to an extraction section of the extraction vessel, the extraction section including one or more liquid-liquid contacting decks;

(f) feeding a second alkaline stream to an upper deck of the one or more liquid-liquid contacting decks of the extraction section, the second alkaline stream including a second alkaline solution suitable for converting mercaptans to mercaptides; and (g) withdrawing a hydrocarbon product stream from an exit opening of the extraction vessel.

2. The process of claim 1, wherein the second alkaline stream includes an alkaline solution essentially free of mercaptides.

3. The process of claim 1, wherein step (a) comprises feeding the liquid hydrocarbon stream to the recirculation section at a location above the feed deck.

4. The process of claim 1, wherein step (f) comprises feeding the second alkaline stream behind a weir that extends upward from the upper deck of the one or more liquid-liquid contacting decks of the extraction section.

5. The process of claim 1 wherein:

each of the liquid-liquid contacting decks of the recirculation section includes a perforated section, and each of the liquid-liquid contacting decks of the extraction section includes a perforated section.

6. A process for removing sulfur compounds from a liquid hydrocarbon stream, the process comprising:

(a) feeding a liquid hydrocarbon stream to a recirculation section of an extraction vessel, the recirculation section including a feed deck and one or more liquid-liquid contacting decks above the feed deck, the recirculation section containing a first alkaline solution suitable for converting mercaptans to mercaptides;

(b) passing the hydrocarbon stream through the recirculation section;

(c) withdrawing a first alkaline stream including the first alkaline solution and mercaptides from the recirculation section;

(d) recirculating at least a part of the first alkaline stream to a top deck of the one or more liquid-liquid contacting decks of the recirculation section;

(e) passing the hydrocarbon stream from the recirculation section to an extraction section of the extraction vessel, the extraction section including one or more liquid-liquid contacting decks;

(f) feeding a second alkaline stream to an upper deck of the one or more liquid-liquid contacting decks of the extraction section, the second alkaline stream including a second alkaline solution suitable for converting mercaptans to mercaptides; and (g) withdrawing a hydrocarbon product stream from an exit opening of the extraction vessel, wherein the first alkaline stream and the second alkaline stream are caustic, and wherein the process does not include a caustic regeneration system.

7. The process of claim 6 wherein: the feed deck has an imperforate bottom wall.

8. The process of claim 6 wherein: the extraction section is in direct communication with the exit opening of the extraction vessel.

9. The process of claim 6 wherein: a majority of the mercaptans in the liquid hydrocarbon stream fed to the recirculation section are converted to mercaptides in the recirculation section.

* * * * *